US006810697B2

(12) United States Patent
Sangiacomo

(10) Patent No.: US 6,810,697 B2
(45) Date of Patent: Nov. 2, 2004

(54) METHOD AND CIRCULAR KNITTING MACHINE FOR MANUFACTURING TUBULAR KNITTED ARTICLES WITH ONE CLOSED END

(75) Inventor: Fulvio Sangiacomo, Brescia (IT)

(73) Assignee: Sangiacomo S.P.A., Brescia (IT)

( * ) Notice: Subject to any disclaimer, the term of this patent is extended or adjusted under 35 U.S.C. 154(b) by 0 days.

(21) Appl. No.: 10/786,928

(22) Filed: Feb. 25, 2004

(65) Prior Publication Data

US 2004/0168477 A1 Sep. 2, 2004

(30) Foreign Application Priority Data

Feb. 27, 2003 (IT) ..... BS2003A0020

(51) Int. Cl.[7] ..... D04B 1/40
(52) U.S. Cl. ..... 66/148
(58) Field of Search ..... 66/147–150, 1 R, 66/8, 95, 104, 114, 115

(56) References Cited

U.S. PATENT DOCUMENTS 5,606,876 A * 3/1997 Sangiacomo ..... 66/148
5,617,744 A * 4/1997 Conti ..... 66/148
5,727,400 A * 3/1998 Lonati et al. ..... 66/148
5,924,309 A * 7/1999 Conti ..... 66/59
6,044,668 A * 4/2000 Conti ..... 66/148
6,158,252 A * 12/2000 Conti ..... 66/148
6,164,091 A * 12/2000 Frullini et al. ..... 66/148
6,176,106 B1 * 1/2001 Lonati et al. ..... 66/95

* cited by examiner

*Primary Examiner*—Danny Worrell
(74) *Attorney, Agent, or Firm*—McGlew and Tuttle, P.C.

(57) ABSTRACT

The invention concerns a method and a circular machine for manufacturing socks with closed toes with the use of picking-up means placed on several linked sectors, which are movable between an annular position corresponding to the cylinder with needles of the machine and a linear position on two parallel touching lines. The sock is picked-up from the cylinder by the pick-up means in the first position and transferred away from the machine, and while the machine can be restarted, the sock is turned upside down, the linked sectors supporting the pick-up means closed to form to parallel rows and the ends of the sock joined so as to close the toe.

8 Claims, 2 Drawing Sheets

METHOD AND CIRCULAR KNITTING MACHINE FOR MANUFACTURING TUBULAR KNITTED ARTICLES WITH ONE CLOSED END

FIELD OF THE INVENTION

This invention concerns circular knitting machines, and refers in particular to the construction of tubular knitted articles with one closed end, such as socks and like, on said knitting machines.

STATE OF THE ART

In the field of the technique taken into consideration here, work procedures and devices have already been proposed and at present are in particular demand, which enable one end of a tubular knitted product to be closed automatically, such as the toe of a sock or like, directly on or on board the knitting machine and however without having to finish the product when off the machine.

When carried out on a circular machine, the knitting of a sock or stocking usually finishes in the toe portion with at least the last row of stitches which remain on the needles of the cylinder, evidently in a circular formation. In order to be able to close the sock toe, the two opposite half circles of tubular knitted fabric on a level with the last rows of knitting must be brought together, forming two edges that touch and which can be joined either by linking or sewing.

One of the methods used at present in performing this operation consists in transferring the knitting from the needles of the cylinder to hooks placed on a dial above the cylinder. The dial is formed by two half disks which can turn on an intermediate diametrical axis so as to move the two end edges of the sock together, which are then joined to form the closed toe.

Another method consists in removing the knitting from the needles of the cylinder using means of transfer onto two half crescents, which on turning overlap, approaching to each other the semicircular opposite ends of the same row of knitting at the end of the knitted article.

A further method envisages transforming a row of circular knitting at the end of the product into two straight segments through the deformation of an annular device holding pick-up needles or hooks. For this purpose the annular device has several articulated sectors side by side, which, when opened, position themselves according to a circumference to receive the tubular knitted fabric from the cylinder needles and when made to approach each other form two almost parallel, facing edges, positioned according to two rectilinear close lengths.

In concrete, on finishing the knitting of a sock with the needles on the cylinder of a circular machine, using this last method, the following steps are carried out in sequence:

position the needles on the cylinder at a certain level; move towards the cylinder top the picking-up devices placed on a plurality of sectors arranged in a opened circular position;

turn the product upside down, drawing it towards the top;

transfer the end parts of the knitted product from the needles of the cylinder to the pick-up devices on said opened sectors;

place the sectors with the pick-up devices close to each other and positioned in two parallel rows so that the knitted fabric forms two close straight sections, move the pick-up devices into a stitching area distant from the cylinder of the machine; and sew the two straight sections of knitting together by a sewing machine so as to close the end, that is the toe, of the product.

Consequently, all the operations to be carried out between the end of the knitting of the sock to final sewing of its end, the toe, take place on board the machine above the cylinder, with a machine cover open, with operating times which are totalised while the machine remains inoperative in that it in the knitting mode.

In particular, the turning upside down of the product chronologically anticipates the pick-up or transfer phase of the knitting from the needles of the cylinder to the pick-up devices, and the aligning and approaching phase of the sectors in two rows is carried out before moving the pick-up devices with the sock turned upside down towards the sewing zone.

This sequence of operating phases is however the cause of important problems which involve both the construction of the machine and the productivity of the same. On the one hand, for example, the machine must be equipped so that machine cover and dial have a wide opening which in itself negatively influences the disposition and stress of the threads. On the other hand, and even more to its disadvantage, the times required for the operating phases carried out on board the machine severely penalise performance.

OBJECTS AND SUMMARY OF THE INVENTION

One object of this invention is to remedy the problems and drawbacks complained about above, by carrying out, at least the turning upside down operation of the product and the approach of the ends of the fabric to be joined together, off the machine.

Another object of the invention is to provide a simplified circular sock knitting machine which, although equipped with means for picking-up and closing one end of the product, still maintains its high production, in that it can start production of a new item while the previous item is being handled and placed in the condition to have the toe re-knitted or sewn.

In other terms, at least the operating times of the turning upside down and closing of a previously knitted article are limited, therefore included, in the time required to knit the following or a new item.

These objects and inherent advantages are achieved by a method of knitting tubular fabric article with one closed end, such as socks with closed toe, on a circular knitting machine equipped with pick-up means in the form of needles or hooks associated with a device for turning the item over so that the bottom is uppermost, and where the pick-up means are positioned on linked supporting sectors, which are able to move from an annular position corresponding to the needles cylinder of the machine and a linear position on two parallel facing rows and which can be moved above and at a distance from the needles cylinder to a sewing area, comprising the step of:

opening, on termination of the knitting of the item, a cover of the machine and moving the supporting sectors of the pick-up means into a circular configuration above the cylinder with needles, transferring the knitted item to the height of at least the last row of knitting from the needles of the cylinder to said pick-up means on said supporting sectors in a circular configuration, moving the knitted item away from the cylinder towards the sewing area, while it is held by said pick-up means on the supporting sectors in a circular configuration, resetting and restarting the machine to start a new item, turning the knitted item over so that the bottom is uppermost through said pick-up devices in a circular configuration, moving the supporting sectors to meet each other in a linear position along two lines so as to place the two opposite ends of knitted fabric to form a straight line and in contact with each other on said pick-up means, and joining the two ends of the knitted fabric now in contact, either by sewing or linking.

BRIEF DESCRIPTION OF DRAWINGS

The invention will however be described in more detail in the description that follows made with reference to the attached drawings, which are indicative and not limiting, in which.

DETAILED DESCRIPTION OF THE INVENTION

Figure 1:
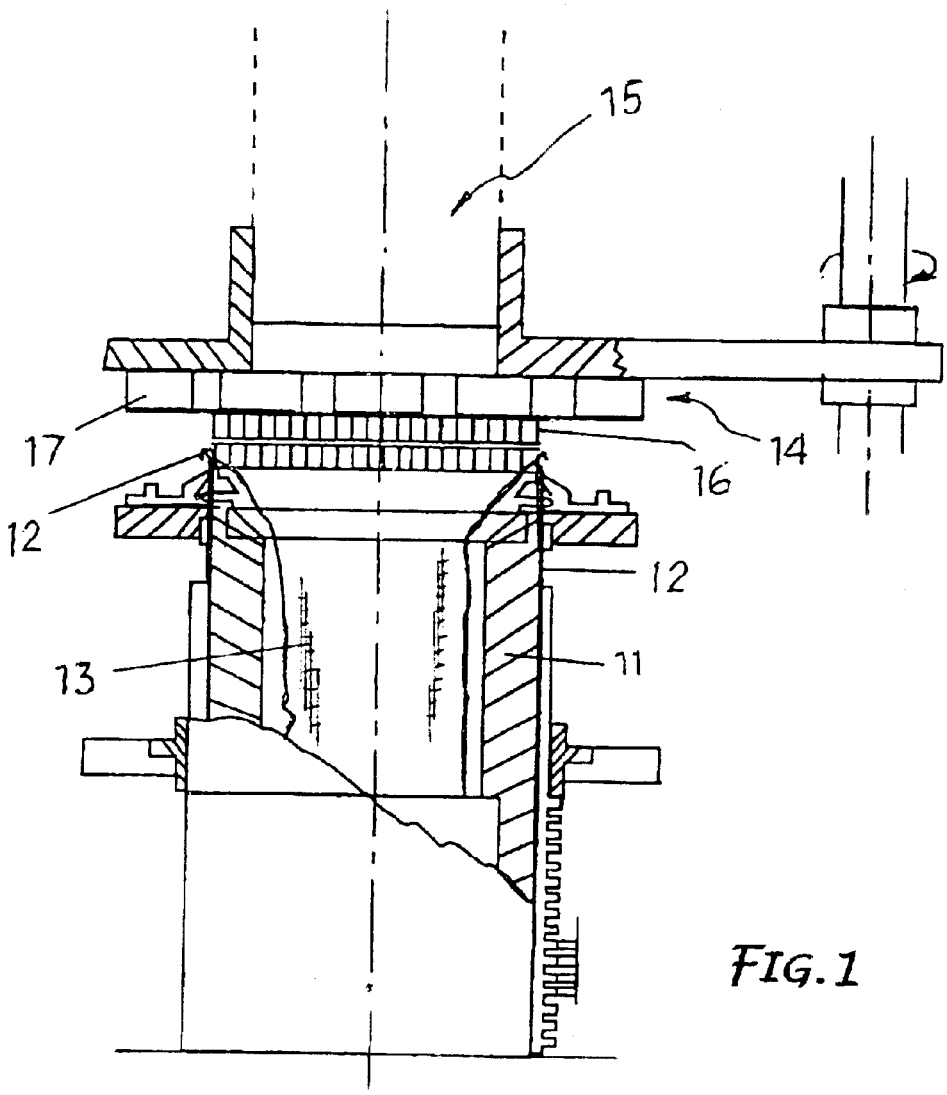
FIG. 1 shows a front schematic view of a cylinder with needles with superimposed an item pick-up device in an annular configuration.

Schematically represented in said drawings are the cylinder 11 of a circular knitting machine with needles 12 for the knitting of fabric of a sock 13, a pick-up device 14 to remove the sock from the needles of the cylinder of the machine and to transfer it to a sewing or linking area to close the toe of the item, and a device for turning the item upside down 15.

The manufacture of the sock 13 on the circular machine takes place in the well-known way and usually finishes with the last rows of fabric at the height of the toe portion of the item, formed and held on the needles 12 of the cylinder.

The pick-up device 14 includes a number of pick-up means 16 in the form of needles or hooks placed on several supporting coplanar plates or sectors 17 carried by supports 18 movable in opposite directions. Pates or sectors 17 are suitable and governed to take on an annular configuration, for a disposition of the pick-up means 16 on a circumference compatible with that of the needles on the cylinder, and a linear configuration, to define two straight edges, one facing the other and with the pick-up means on one edge facing towards those on the opposite edge. Furthermore, said supporting plates or sectors 17, through their supports 18, are controlled and move on a horizontal plane, by rotating on a vertical axis or crosswise, between a position over the cylinder and distant from the latter as far as the sewing or linking area 19.

This area 19 can be dedicated to a single circular machine or to a group of machines, and in any case includes a sewing or linking group of the type already known in the field.

The turning upside down device 15, is generally pneumatic, it can be placed above and directly associated with the pick-up device 14, movable in order to follow the horizontal movements of the latter. As an alternative, it can be statically positioned in the sewing or linking area and interact with the pick-up device when the latter reaches this area, this would allow a reduction in the overall size of the moving parts and facilitate access to the cylinder of the machine with the pick-up device.

Figure 2:
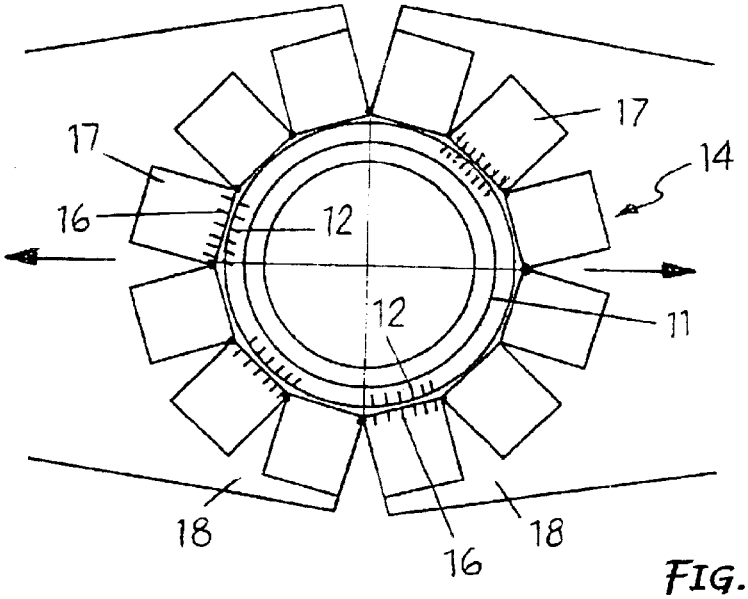
FIG. 2 shows view from above of the diagram in FIG. 1.

According to the operating process described above, once the knitting of the item, that is the sock 13, is finished and the cover of the machine is open, the pick-up device 14 in the annular position is moved above the cylinder and managed so as to remove, using the relative pick-up means 16, the stitches from the needles of the cylinder—FIGS. 1 and 2. Remaining in its annular configuration, the pick-up device 14 is then moved away from the machine taking the item with it.

With the device 14 distant from the cylinder, the cover of the machine can be closed and the machine restarted to produce a new item. Therefore, the item transported away from the machine by the pick-up device 14 is turned upside down by the turning over device 15. This operation can be carried out during the movement of the pick-up device 14 towards the closing area or when it reaches the closing area, according to where the turnover device is positioned, either directly above the pick-up device or separated from it in a fixed position.

Figure 3:
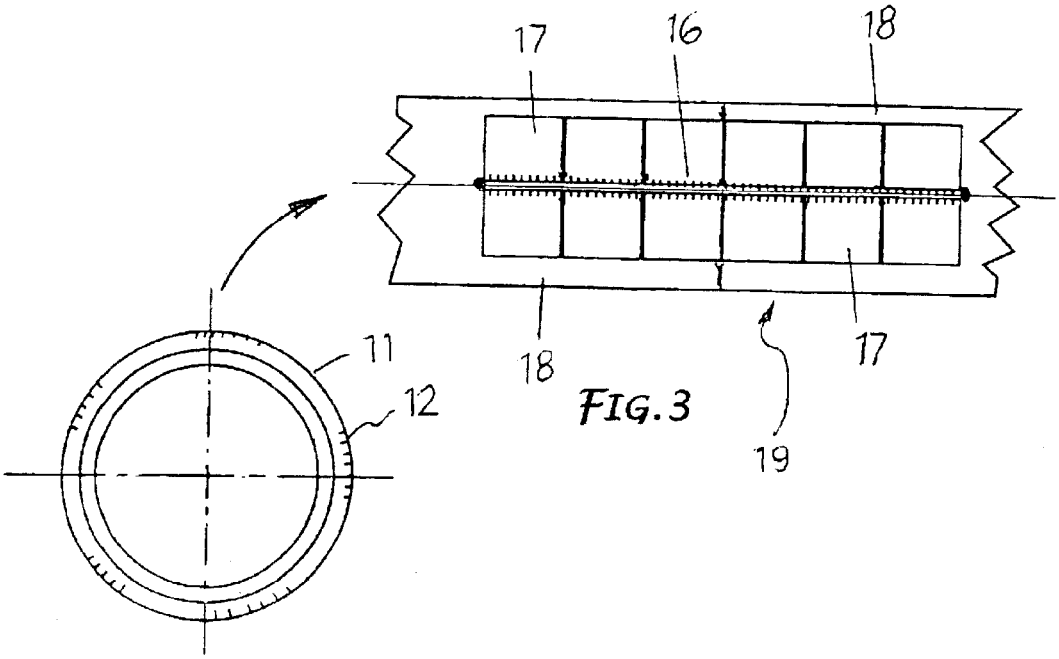
FIG. 3 shows a similar view as the one in FIG. 2, but with the pick-up device distant from the cylinder and in a linear configuration along two lines.

Once the item has been turned over with the bottom uppermost, the supporting plates or sectors of the pick-up means are moved adjacent to each other to form two parallel rows—FIG. 3—so as to position the two opposite ends of the item in close contact with each other and must then be joined by a sewing or linking.

What is claimed is:

1. A method of knitting tubular fabric articles with one closed end, such as socks with closed toe, on a circular knitting machine equipped with pick-up means in the form of needles or hooks associated with a device for turning the item over so that the bottom is uppermost, and where the pick-up means are positioned on a number of linked supporting sectors, which are able to move from an annular position corresponding to a needle cylinder of the machine and a linear position on two parallel facing rows and movable above and at a distance from the needles cylinder to a sewing area, comprising the steps of:

opening, on termination of the knitting of the item, a cover of the machine and moving the supporting sectors of the pick-up means into a circular configuration above the cylinder with needles, transferring the knitted item to the height of at least the last row of knitting from the needles of the cylinder to said pick-up means on said supporting sectors in a circular configuration, moving the knitted item away from the cylinder towards the sewing area, while it is held by said pick-up means on the supporting sectors in a circular configuration, resetting and restarting the machine to start a new item, turning the knitted item over so that the bottom is uppermost through said pick-up means in a circular configuration, moving the supporting sectors to meet each other in a linear position along two lines so as to place the two opposite ends of knitted fabric to form a straight line and in contact with each other on said pick-up means, and joining the two ends of the knitted fabric now in contact, either by sewing or linking.

2. A method according to claim 1, in which the turning upside down of the item is carried out off the machine, coinciding with the movement of the pick-up means away from the cylinder of the machine.

3. A method according to claim 1, in which the turning upside down of the item is carried out off the machine when the pick-up means are in the sewing or linking area.

4. A method according to claim 1, in which the support sectors with pick-up means take on the linear configuration of two parallel rows after the item has been turned upside down during or on termination of the movement of the pick-up means towards the sewing or linking area.

5. Circular knitting machine comprising a cylinder with needles for the manufacture of a tubular fabric item such as a sock, means to pick-up the article from the needles of the cylinder, in the shape of needles or hooks positioned on several linked support sectors movable from an annular position corresponding to the cylinder with needles of the machine and a linear position in to facing parallel rows, said support sectors being also movable from a position above the cylinder with needles and a position distant from the latter in a sewing or linking area to close the end of the tubular fabric, characterised by means to control and move the pick-up means from the position over the cylinder to the sewing or linking area, means for configuring the pick-up means in an annular shape when they are positioned above the cylinder and in a linear shape in two lines when they are distant from the cylinder, a device for turning the item upside down, associated with pick-up devices and managed so as to turn the item upside down when the pick-up means are distant from the cylinder and position said pick-up means in a linear formation in two lines after the item has been turned upside down.

6. Circular sock knitting machine according to claim 5, in which the turning upside down device is directly associated and moves together with the pick-up means.

7. Circular sock knitting machine according to claim 5, in which the turning upside down device is stationary at or nearby the sewing or linking area.

8. Circular sock knitting machine according to claim 5, in which the pick-up means are movable from the position above the cylinder to the sewing or linking area position by turning on an axis or translating, the sewing or linking area being dedicated to a single machine or common to several machines.

* * * * *